United States Patent [19]

Mayer et al.

[11] Patent Number: 4,928,041

[45] Date of Patent: May 22, 1990

[54] FLAT DISPLAY DEVICE

[75] Inventors: Uwe Mayer, Kirchheim-Teck; Kurt-Manfred Tischer, Wendlingen, both of Fed. Rep. of Germany

[73] Assignee: Nokia Graetz, Pforzheim, Fed. Rep. of Germany

[21] Appl. No.: 306,985

[22] Filed: Feb. 6, 1989

[30] Foreign Application Priority Data

Feb. 25, 1988 [DE] Fed. Rep. of Germany ..... 3805858

[51] Int. Cl.[5] ..... H01J 29/70; H01J 29/56

[52] U.S. Cl. ..... 315/366; 315/371

[58] Field of Search ..... 315/366, 371, 370; 313/422

[56] References Cited

U.S. PATENT DOCUMENTS 3,435,278 3/1969 Carlock et al. ..... 315/366

FOREIGN PATENT DOCUMENTS 0091641 5/1984 Japan ..... 315/366

OTHER PUBLICATIONS

Koelsch, CRT Pin Cushioning Correction Circuit, IBM Technical Disclosure Bulletin, vol. 5, No. 10, Mar. 1963, pp. 44–47.

*Primary Examiner*—Gregory C. Issing

*Attorney, Agent, or Firm*—Peter C. Van Der Sluys

[57] ABSTRACT

The invention relates to a flat display device with a faceplate (1) having either an outward curvature or bulging inwards under the action of atmospheric pressure, the device also comprising a planar deflection device (8) to deflect the electron beams (13, 14) in each line. With a view to obtaining a pure-color image, the deflection voltages are corrected according to the particular distance between the deflection device (8) and the faceplate (1), thereby ensuring that the electron beams (13, 14) will impinge only on the appropriate equidistant phosphor dots or strips (4). The formula for calculating the correction factor (K) is stated.

9 Claims, 2 Drawing Sheets

FLAT DISPLAY DEVICE

The present invention relates to a flat display device of the type that displays information by generating a plurality of lines, said display device having a phosphor-coated glass faceplate and a trough-shaped back metal envelope defining an evacuated interior space, within which there is arranged an area cathode with an extract anode in front of it and, between the latter and the faceplate, a control structure and a deflection device to which there are applied deflection voltages used to deflect a plurality of electron beams used to generate each line.

A flat display device in which a flat glass plate as the back part and trough-shaped front part with a phosphor coating on its interior side constitute a vacuum-tight housing is known from DEOS 35 29 041. A large number of tungsten filaments are arranged as an area electrode in front of a segmented counterelectrode. A perforated extract anode is present in front of each tungsten filament. Situated between the phosphor coating and the front part of the extract anodes there is a deflection device that deflects the electron beams within each line and from line to line. Provision is made for a triple or sixfold deflection within each line.

It is known that a planar faceplate of a flat display device with a vacuum in its interior space will deform under the action of atmospheric pressure. The distance between the deflection device and the phosphor coating will therefore change. The electron beams will impinge not only on the appropriate phosphor dots, but partly also on the adjacent phosphor dots. The same effect occurs when the faceplate of a flat display device is made to bulge outwards in order to enhance its implosion resistance.

The object of the present invention is to provide a process for the operation of a flat display device that will ensure the attainment of pure-colour image reproduction notwithstanding the varying distance between the deflection device and the phosphor coating.

This object is attained by modulating the deflection voltages in such a way as to be inversely proportional to the particular distance between the deflection device and the phosphor coating. Further advantageous features of the invention are realized by modulating the deflection voltage in accordance with a factor K that varies with the distance between the electron beam and the center of a line being generated and by interconnecting adjacent groups of conductors of the deflection device, so that the same corrected deflection voltage may be applied to the interconnected groups.

Figure 1:
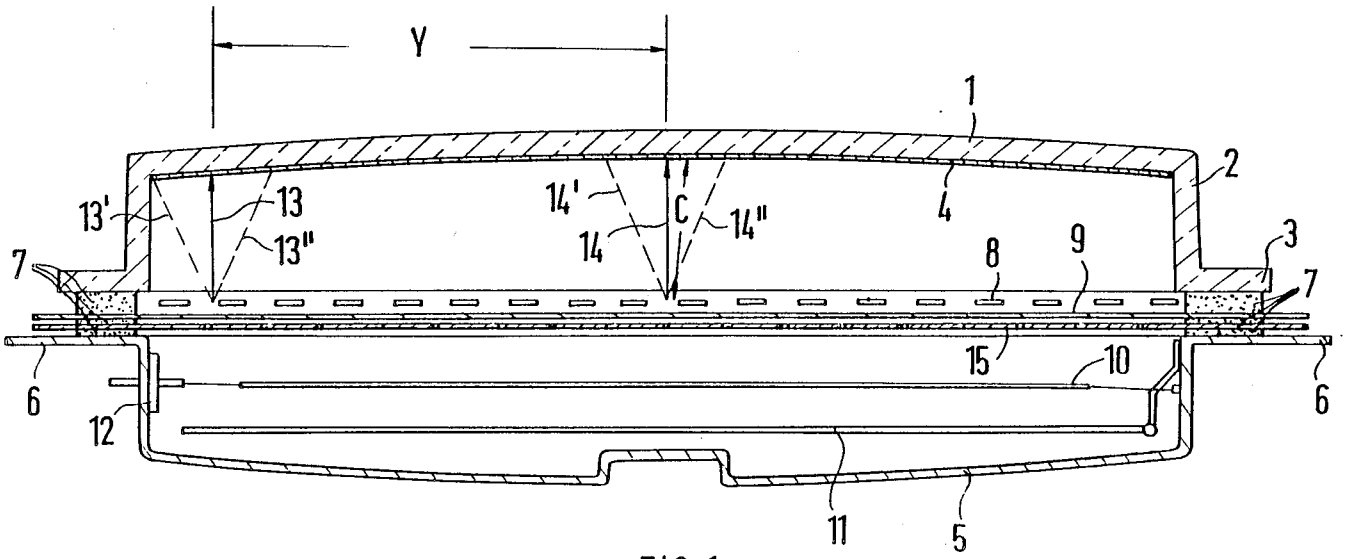

The invention will now be explained in greater detail with reference to the specific embodiment thereof shown in the accompanying drawings, of which:

FIG. 1 is a section through the display device, and

Figure 2:
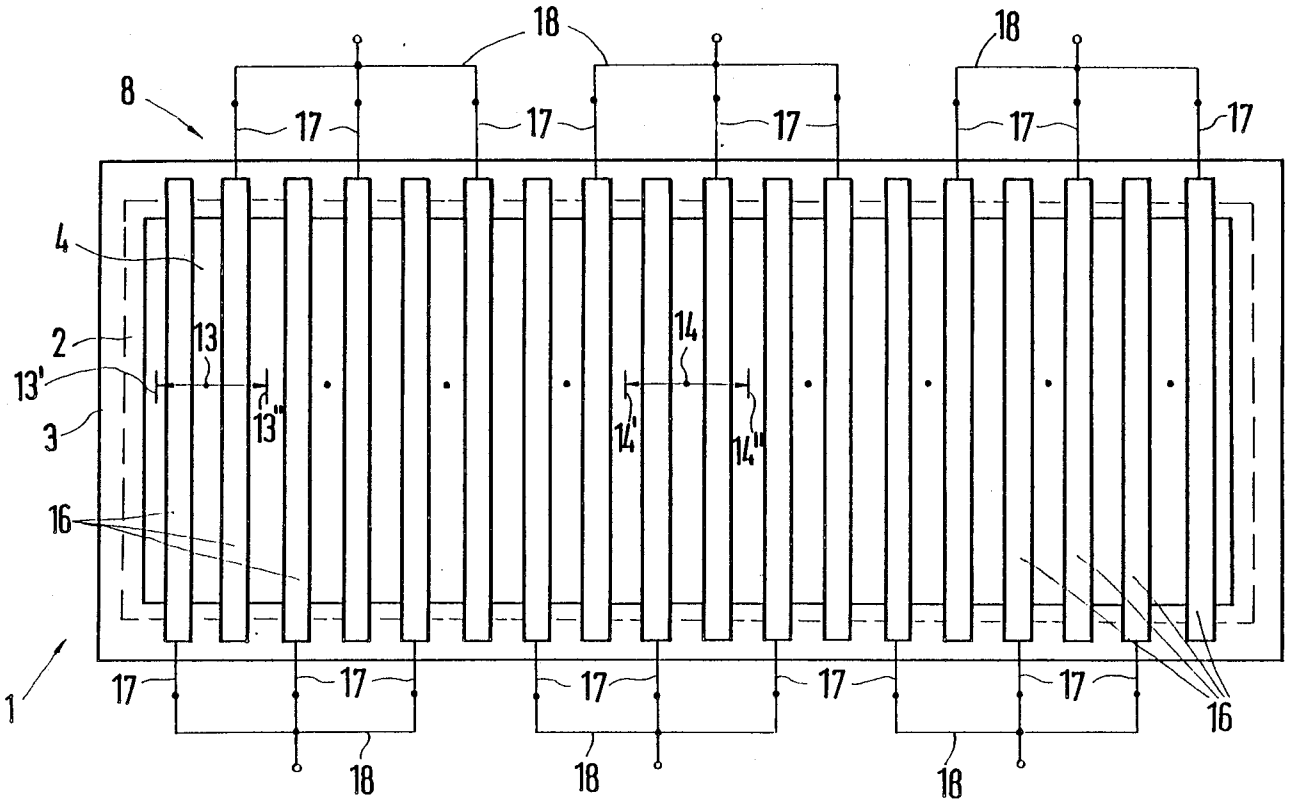

FIG. 2 a plan view of the deflection device.

The flat display device, a cross section of which is shown in FIG. 1, comprises a trough-shaped glass faceplate 1 whose side walls 2 terminate in a circumferential flange 3. The inside of the faceplate 1 is coated with phosphor 4 in the form of dots or strips. The back of the flat display device is constituted by a metal envelope 5, which is once again provided with a circumferential flange 6. In the area of their flanges 3 and 6 the faceplate 1 and the back envelope 5 are joined together in a vacuum-tight manner by the use of a glass solder 7.

In the interior of the flat display device there are a deflection device 8, a control structure 9, a perforated extract anode 15, an area cathode consisting of a periodic array of heating filaments 10 and a counterelectrode 11. The electric connections of the deflection device 8 (not in view) and the control structure are passed to the outside through the glass solder 7, while the heating filaments 10 are connected to vacuum-tight multiterminal feedthrough bushings 12 in the side wall 2 of hte back envelope 5 and the counterelectrode 11 is attached to the back envelope.

The deflection device 8 consists of the electric conductors 16 arranged parallel to each other; in FIG. 1 these conductors run normal to the plane of the paper. The electron beams pass between the conductors 16 and are accelerated to the faceplate. The electron beams are thus deflected in each line according to the magnitude and the polarity of the deflection voltage applied to any two adjacent conductors 16 prior to being accelerated to the faceplate. By way of example, let us consider an electron beam 13 at the left-hand edge of the deflection device and an electron beam 14 at the centre thereof. The respective deflection ranges are indicated by the broken lines 13' and 13'' in the former case and 14' and 14'' in the latter. Given the outward bulging of the faceplate 1, it can be seen that the distance between the deflection device 8 and the phosphor coating 4 is different for each electron beam and also for each deflected position. The distance between the deflection device 8 and the phosphor coating 4 at the position of the central electron beam is designated by C, while the distance between the electron beam 14 at the centre and the electron beam 13 at the edge is represented by y. When the deflection voltages are the same for all conductor pairs, as is the case in the state of the art, the deflection angle of all the electron beams in each line will likewise be the same. It follows from this that the deflection distance on the phosphor coating will vary according to the distance between the deflection device 8 and the phosphor coating 4. Consequently, a pure-colour image will no longer be obtained.

With a view to ensuring that all electron beams will impinge only on the appropriate phosphor dots, the deflection voltages are therefore corrected in such a manner as to multiply each deflection voltage by the correction factor K.

The correction factor is calculated in first and sufficient approximation from the following formula:

$$K=1+y^2/2RC+(y^2/2RC)^2$$

where R stands for the radius of the curved faceplate 1. When the deflection voltages are corrected in this manner, the electron beams will in each case impinge on the appropriate equidistant phosphor dots and a pure-colour image will always be obtained.

FIG. 2 shows a plan view of the deflection device 8 with the faceplate 1 lying behind it. The deflection device 8 consists of the conductors 16 arranged in parallel with each other, with the electron beams passing between any two adjacent conductors. In FIG. 2 the electron beams are represented by heavy dots and are always shown in their central position. The electron beam at the centre of the device and the electron beam at the left-hand edge thereof, as well as their respective deflection ranges, are designated as in FIG. 1. Deflection voltages are applied to any two adjacent conductors and to this end the conductors are provided with electrical connections 17 arranged alternately on opposite sides.

Correction of each individual deflection voltage would require each connection 17 of each conductor 16 of the deflection device 8 to be passed to the outside of the flat display device. With a view to avoiding this large number of feedthrough bushings, it is however possible to combine a certain number of adjacent pairs of conductors 16 that deflect neighbouring electron beams. In the case of neighbouring electron beams the variation in the distances between the deflection device and the phosphor coating is so small that use of identical deflection voltages will not produce a visible error.

Three such groups can be advantageously formed and, of these, the two outer groups can again be electrically combined, because the same spatial conditions prevail within them. Connectors 18 are therefore provided in FIG. 2 for the formation of the groups and provide an electrical link between each set of connections 17 belonging together.

When the faceplate is curved not only along the lines but also at right angles to them, the deflection voltages have to be modified with the correction factor individually for each line according to the particular distance between the deflection device and the phosphor coating. In this case, once again, it is possible to use the same corrected deflection voltage for several lines in order to simplify the necessary circuit arrangements.

Use of this method of modifying the deflection voltages with the correction factor K is not limited to the case of flat display devices with a trough-shaped bulging faceplate. The method can also be used to ensure pure-colour images in the case of flat display devices with planar faceplates that, following the evacuation of the flat display device, bulge inwards under the action of atmospheric pressure. The correction factor K is then calculated as previously described, though one has to change the sign of the second term. The correction formula is therefore as follows:

$$K=1-y^2/2RC+(y^2/2RC)^2.$$

We claim:

1. A process for operating a flat display device of the type that displays information by generating a plurality of lines, said display device having a phosphor-coated glass faceplate and a trough-shaped back metal envelope defining an evacuated interior space, within which there is arranged an area cathode with an extract anode in front of it and, between the latter and the faceplae, a control structure and a deflection device to which there are applied deflection voltages used to deflect a plurality of electron beams used to generate each line, characterized in that the deflection voltages are modulated in such a way as to be inversely proportional to the particular distances between the deflection devices (8) and the phosphor coating (4).

2. A process according to claim 1 wherein the glass faceplate bulges outwardly, characterized in that the deflection voltages are modulated in accordance with a factor $K=1+(y^2/2RC)+(y^2/2RC)^2$, where y represents a distance between each electron beam and the centre of a line being generated, R the radius of the curvature of the faceplate (1), and C the distance between the deflection device (8) and the phosphor coating (4) at the centre of the line being generated.

3. Process according to claim 2, characterized in that adjacent groups of conductors of the deflection device (8) are interconnected and have the same corrected deflection voltage applied to them.

4. Process according to claim 3, characterized in that three groups are formed.

5. Process according to claim 2, characterized in that the deflection voltages are also modulated from line to line.

6. A process according to claim 1 wherein the glass faceplate bulges inwardly, characterized in that the deflection voltages are modulated in accordance with a factor $K=1-(y^2/2RC)+(y^2/2RC)^2$, where y represents a distance between each electron beam and the centre of a line being generated, R the radius of the curvature of the faceplate (1), and C the distance between the deflection device (8) and the phosphor coating (4) at the centre of the line being generated.

7. A process according to claim 6, characterized in that adjacent groups of conductors of the deflection device (8) are interconnected and have the same corrected deflection voltage applied to them.

8. A process according to claim 7, characterized in that three groups are formed.

9. A process according to claim 6, characterized in that the deflection voltages are also modulated from line to line.

* * * * *